US011490670B2

(12) United States Patent
Chaleteix et al.

(10) Patent No.: US 11,490,670 B2
(45) Date of Patent: Nov. 8, 2022

(54) VENTILATION DEVICE

(71) Applicant: DECATHLON, Villeneuve d'Ascq (FR)

(72) Inventors: Tom Chaleteix, Villeneuve d'Ascq (FR); Lucile Durdan, Villeneuve d'Ascq (FR)

( * ) Notice: Subject to any disclaimer, the term of this patent is extended or adjusted under 35 U.S.C. 154(b) by 74 days.

(21) Appl. No.: 17/056,010

(22) PCT Filed: May 9, 2019

(86) PCT No.: PCT/FR2019/051050
§ 371 (c)(1),
(2) Date: Nov. 17, 2020

(87) PCT Pub. No.: WO2019/220037
PCT Pub. Date: Nov. 21, 2019

(65) Prior Publication Data

US 2021/0212396 A1 Jul. 15, 2021

(30) Foreign Application Priority Data

May 17, 2018 (FR) ..... 18 54126

(51) Int. Cl.
*A41D 27/28* (2006.01)
*A44B 19/30* (2006.01)
(Continued)

(52) U.S. Cl.
CPC ..... *A41D 27/285* (2013.01); *A44B 19/08* (2013.01); *A44B 19/308* (2013.01); *A44B 19/34* (2013.01); *A44B 19/36* (2013.01)

(58) Field of Classification Search
CPC ..... A44B 19/08; A44B 19/34; A44B 19/36; A44B 19/18; A44B 19/58; A44B 19/00; A44B 19/40; A41D 27/285
See application file for complete search history.

(56) References Cited

U.S. PATENT DOCUMENTS 1,982,845 A * 12/1934 Wagman ..... A45C 3/06 383/33
4,825,514 A * 5/1989 Akeno ..... A44B 19/36 24/387

(Continued)

FOREIGN PATENT DOCUMENTS

EP 1002470 A2 5/2000
KR 2016 0142046 A 12/2016

OTHER PUBLICATIONS

English language abstract of KR 2016 0142046.

*Primary Examiner* — Robert Sandy
*Assistant Examiner* — Rowland Do
(74) *Attorney, Agent, or Firm* — Robert Facey

(57) ABSTRACT

A ventilation device including a flexible support having first and second edges delimiting a longitudinal opening and being provided with first and second closing devices arranged to cooperate with one another, the ventilation device including at least one elastic spacer member which includes a first tab extending along the first edge and a second tab extending along the second edge, the elastic spacer member being constrained when the closing devices are in the closed position, so that the first and second tabs tend to separate from one another, the length of at least the first tab being less than half the length of the first edge.

19 Claims, 2 Drawing Sheets

(51) Int. Cl.

| | |
|---|---|
| ***A44B 19/08*** | (2006.01) |
| ***A44B 19/36*** | (2006.01) |
| ***A44B 19/34*** | (2006.01) |

(56) References Cited

U.S. PATENT DOCUMENTS

| | | | | |
|---|---|---|---|---|
| 5,033,126 | A * | 7/1991 | Wruck | A41D 17/02 2/919 |
| 6,339,845 | B1 * | 1/2002 | Burns | A41D 31/102 2/243.1 |
| 8,276,213 | B2 * | 10/2012 | Maurer | A41D 27/24 2/248 |
| 9,301,556 | B2 * | 4/2016 | Koller | A41D 3/02 |
| 11,266,215 | B2 * | 3/2022 | Larson | A45C 13/103 |
| 2005/0172381 | A1 | 8/2005 | Bush | |
| 2009/0178174 | A1 * | 7/2009 | Cash, Jr. | A41D 27/28 2/243.1 |
| 2016/0135529 | A1 * | 5/2016 | Traulle | A41D 3/02 2/243.1 |
| 2016/0345647 | A1 * | 12/2016 | Ladaev | A61B 5/02233 |
| 2018/0279704 | A1 | 10/2018 | Cienski | |

* cited by examiner

VENTILATION DEVICE

BACKGROUND

The present disclosure relates to the field of ventilation devices allowing air to circulate through a garment, a tent canopy or a sleeping bag.

It is vital to provide ventilation openings through garments, particularly for sports, and in tents in order to allow the entry of fresh air and remove perspiration. The ventilation openings further allow renewing the air in a confined space.

Most known ventilation devices consist of a longitudinal opening provided in a support, which can be closed or opened by means of a zipper. The disadvantage of this type of ventilation device is that the space defined by the edges of the opening is not sufficient to allow the quantity of air necessary for satisfactory ventilation to pass.

The disclosure relates to a ventilation device comprising a flexible support having a first edge and a second edge provided with first and second closing device arranged to cooperate with one another, the closing devices having an open position in which the first and second edges are separated from one another so as to delimit a longitudinal opening in the flexible support, and a closed position in which the first and second edges cooperate so as to block the opening, the ventilation device further comprising at least one elastic spacer member which includes a first tab extending along the first edge and a second tab extending along the second edge.

Document EP1002470 describes a ventilation device of this type comprising a spacer member. FIG. 1 illustrates the ventilation device described in this document according to the prior art. The spacer member 2 of this device comprises a first tab 4 extending over the entire length of the first edge 3 and a second table 6 extending over the entire length of the second edge 5.

As can be observed in FIG. 1, the maximum spacing between the first and second edges 3, 5 offered by the ventilation device follows the curve of the first and second tabs and consequently remains small. Also, the quantity of air that can pass through the opening is insufficient to supply effective ventilation. A device of this type does not allow the removal of perspiration, or rapidly renewing the air, which impairs the comfort of the user.

Moreover, the ventilation device of document EP1002470 is particularly heavy and bulky so that is risks inconveniencing the user, particularly if it is positioned on a garment.

SUMMARY

One goal of the present disclosure is to propose a ventilation device correcting the aforementioned problems.

To this end, the disclosure relates to a ventilation device in which, when the closing devices are in the closed position, the elastic spacer member is constrained so that the first and second tabs tend to separate from one another, the length of at least the first tab being less than half the length of the first edge.

The flexible support preferably includes a sheet of foldable or windable material. It can include of a tent canopy, a sleeping bag or a portion of a garment such as a sleeve of a jacket. The longitudinal opening is provided in the flexible support and passes through it. The longitudinal opening extends in a longitudinal direction.

The spacer member preferably has a deployed position and a folded position in which it is further constrained. It is brought from the deployed position to the folded position by bringing its first tab and its second tab closer together. In the folded position the first and second tabs tend to separate from one another. The elastic spacer member can be made of plastic material or of metal. The elastic spacer member is preferably arched. Without departing from the scope of the disclosure, it can also be substantially rectilinear in the deployed position and have an arched shape when it is constrained. The elastic spacer member preferably extends in a plane parallel to a plane in which the first and second edges extend. It can be attached to the flexible support by sewing, by gluing or by any other adequate means of attachment.

The first tab preferably comprises a first end attached to the flexible support in proximity to the first edge and the second tab preferably comprises a first end attached to the flexible support in proximity to the second edge.

When the first and second closing device are in the closed position, the first edges are positioned side by side and air cannot pass through the flexible support. In this position, the elastic spacer member is in the folded position. The first and second tabs of the spacer member are near one another and are preferably substantially parallel. The spacer member is constrained and its first and second tabs tend to resume their deployed shape and space the first edge and the second edge from one another. However, the closing devices oppose this spacing and hold the spacer member constrained.

When the closing devices are brought into the open position, they are separated from one another so that the longitudinal opening is no longer blocked. The elastic spacer member is deployed and the first and second tabs are spaced from one another. The spacing of the tabs causes the spacing of the first and second edges of the flexible support and therefore the enlargement of the longitudinal opening in a direction transverse to the first and second edges.

It has been observed that, surprisingly, the spacing offered by a spacer member according to the disclosure, having at least one tab having a length less than half the length of an edge, is considerably greater than the spacing offered by a spacer member such as that of document EP1002470, the tabs of which extend over the entire length of the edges.

In fact, the tabs of the device of this prior art document have a first end attached in proximity to a first end of the longitudinal opening and a second end, opposite to the first end, attached in proximity to a second end of the longitudinal opening. Yet, the first and second edges join at the ends of the longitudinal opening, and can only be spaced very slightly. In addition, a tab of this kind forms a practically zero angle with the longitudinal direction of the longitudinal opening. The spacing caused by a member of this type is therefore minimal and solely linked to the curvature of the tabs.

On the contrary, the first tab of the spacer member of the ventilation device according to the disclosure, the length of which is less than half the length of the first edge, has at least one end attached to the flexible support in proximity to a central portion of the first edge or upstream of this central portion. Yet, it is at this central portion that the first edge can have a maximum spacing relative to the second edge. In addition, a tab of this type, of reduced length, forms a non-zero angle, preferably greater than 10°, with the longitudinal direction of the longitudinal opening. Consequently, the spacer member of the device according to the disclosure allows increasing the spacing of the first and second edges relative to one another and consequently improving the ventilation effect produced by the device.

In addition, said at least one tab of reduced length of the spacer member of the ventilation device according to the disclosure is much shorter than those of the spacer member described in EP1002470. This reduces the bulk and the inconvenience likely to be caused by the spacer member, particularly when it is positioned on a garment. This also reduces the costs of manufacture and makes the device lighter.

In addition, the use of a spacer member including at least one first tab with a length smaller than half the length of the first edge allows providing a sufficient space along the first edge to add as second spacer member, in order to further improve the spacing of the first and second edges relative to one another.

Preferably, the length of the first tab is less than one-third of the length of the first edge, thanks to which the angle formed between the first tab and the longitudinal direction of the opening is further increased. The spacing offered by the spacer member is still greater, and the ventilation is further improved, the weight and costs of manufacture of the ventilation device are further reduced.

Advantageously, the length of the second tab is less than half the length of the second edge. One advantage is also to increase the spacing of the second edge relative to the first edge and relative to a longitudinal direction of the longitudinal opening.

Preferably, the length of the second tab is substantially equal to the length of the first tab. In this manner, the opening defined by the first and second edges is substantially symmetrical relative to the longitudinal direction of the opening and the spacing of the first and second edges relative to the longitudinal direction of the opening is a maximum.

Advantageously, the elastic spacer member comprises a stem of plastic material. A stem of this type can be manufactured easily and at reduced cost. In addition, it is light and easily deformable without risking breakage when it is constrained by setting the closing devices into the closed position.

According to a particularly advantageous feature, the ventilation device comprises at least one first sheath integral with the flexible support in which extends at least partially the elastic spacer member. A sheath of this type allows guiding the spacer member while attaching it to the flexible support.

The first sheath is preferably integral with the flexible support.

Preferably, the first sheath comprises a first lateral portion extending along the first edge, and a second lateral portion extending along the second edge. The first lateral portion receives the first tab of the elastic spacer member. The second lateral portion receives the second tab of the elastic spacer member.

Also preferably, the first sheath surrounds a first end of the longitudinal opening.

Advantageously, the ventilation device comprises a reinforcing part cooperating with the elastic spacer member. One advantage is to avoid having the elastic spacer member break with it is constrained. This reinforcing part preferably cooperates with a central portion of the elastic spacer member and possibly with all or part of the first and second tabs. It can comprise an insert extending in the spacer member and/or a sleeve extending around the spacer member. It can comprise an insert extending in the spacer member and/or a sleeve extending around the spacer member. This insert and/or this sleeve allow in particular improving the resistance to wear of the ventilation device while ensuring sufficient spacing of the first and second tabs during the unfolding of the spacer member, even when the latter has remained constrained for a long time.

Moreover, the reinforcing part can comprise a portion protruding from the spacer member, so as to form a portion attaching the elastic spacer member to the flexible support. In this variant, the protruding portion also facilitates the attachment of the elastic spacer member to the flexible support. In addition, it prevents the pivoting of the spacer member relative to the support or relative to the sheath when the ventilation device is provided with one.

Without departing from the scope of the disclosure, the reinforcing part can be made of metal or of plastic. It can be made of a different material from the material of the elastic spacer member. Likewise, the protruding portion can be made of a material different from the material of the insert or of the sleeve and of the material of the spacer member.

Preferably, the elastic spacer member has a "U" or a "V" shape. It is understood that the branches of the "U" or of the "V" form the tabs of the elastic spacer member. A shape of this type is particularly suited for the tabs running along the edges of the flexible support. In addition, an elastic spacer member having a shape of this type when it is deployed can be further constrained by moving the first and second tabs closer to one another. Conversely, when a spacer member of this type is in the folded position, its tabs naturally tend to separate, toward the deployed position, which is particularly suited to the present application.

Advantageously, the elastic spacer member is positioned in proximity to a first end of the longitudinal opening. Also, the first tab of the spacer member extends along a first end of the first edge and the second tab extends along a first end of the second edge. One advantage is to be able to position a second spacer member in proximity to a second end of the longitudinal opening.

Preferably, the elastic spacer member comprises a central portion mounted on the flexible support in proximity to the first end of the longitudinal opening. It is understood that the spacer member substantially surrounds the first end of the longitudinal opening.

According to a particularly advantageous feature, the ventilation device comprises a second elastic spacer member which includes a first tab extending along the first edges and a second tab extending along the second edge, the second elastic spacer member being constrained, when the closing devices are in the closed position, so that the first and second tabs tend to separate from one another, the length of at least the first tab of the second elastic spacer member being less than half the length of the first edge. The second spacer member exerts an additional spacing force on the first and second edges, in a direction transverse to said edges, and allows the further separation of the first and second edges. It preferably extends in a plane parallel to a plane in which the first and second edges extend. The second spacer member allows a further improvement in the ventilation supplied by the ventilation device.

Inasmuch as the first tabs of the two spacer members have a length less than half the length of the first edge, they can both extend along the first edge without overlapping.

The second elastic spacer member is preferably arched.

Advantageously, the second elastic spacer member is positioned in proximity to a second end of the longitudinal opening, opposite to the first end of the longitudinal opening. Thus, the first spacer member exerts a spacing force on a first end portion of the edges extending between the first end of the longitudinal opening and half of the edges and the second spacer member exerts a spacing force on a second end portion of the edges extending between the second end of the longitudinal opening and half of the edges. If the closing devices are partially open, so that the first end portions of the edges are no longer in contact with one another, then the first elastic spacer member allows separating said first end portions of the edges. Likewise, if the closing devices are partially opened so that the second end portions of the edges no longer cooperate, then the second elastic spacer member allows separating said second end portions of the edges.

Preferably, the second elastic spacer member comprises a central portion mounted on the flexible support in proximity to the second end of the longitudinal opening. The second spacer member preferably surrounds the second end of the longitudinal opening. The tabs of the second spacer member are positioned facing the tabs of the first spacer member.

Preferably, the ventilation device comprises a second sheath integral with the flexible support, in which extends at least partially the second elastic spacer member. The second sheath is preferably integral with the flexible support. It preferably comprises a first lateral portion, extending along the first edge, and receiving the first tab of the second elastic spacer member. It also comprises a second lateral portion, extending along the second edge, and receiving the second tab of the second elastic spacer member.

The second sheath allows attaching the second elastic spacer member to the flexible support, while guiding it.

Advantageously, the first closing device comprises a first zipper portion and the second closing device comprises a second zipper portion, configured to cooperate with the first zipper portion to close the longitudinal opening when the first and second closing devices are placed in the closed position.

In a non-limiting manner, the ventilation device can comprise a cursor configured to slide along the first and second zipper portions in order to set into cooperation or in order to interrupt the cooperation between said two zipper portions.

The disclosure also relates to a garment, for example a jacket or trousers, comprising at least one ventilation device according to the disclosure.

The disclosure also relates to a tent comprising at least one ventilation device according to the disclosure.

The disclosure also relates to a sleeping bag comprising at least one ventilation device according to the disclosure.

BRIEF DESCRIPTION OF THE DRAWINGS

The disclosure will be better understood upon reading the description that follows of the embodiments of the disclosure, given by way of non-limiting examples, with reference to the appended drawings, in which.

DETAILED DESCRIPTION

The disclosure relates to a ventilation device, particularly for a garment, tent or sleeping bag.

Figure 1:
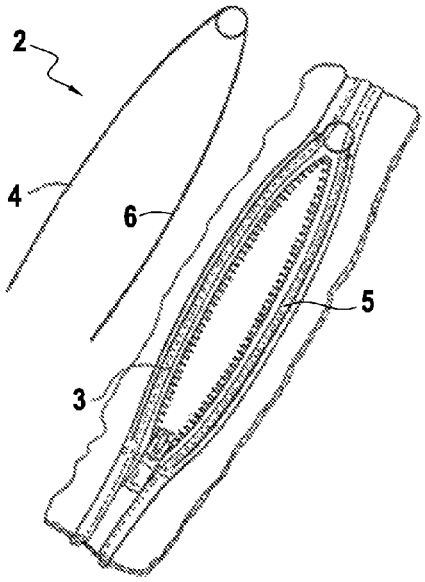
FIG.1 Prior art
FIG. 1 illustrates a ventilation device according to the prior art.
Figure 2:
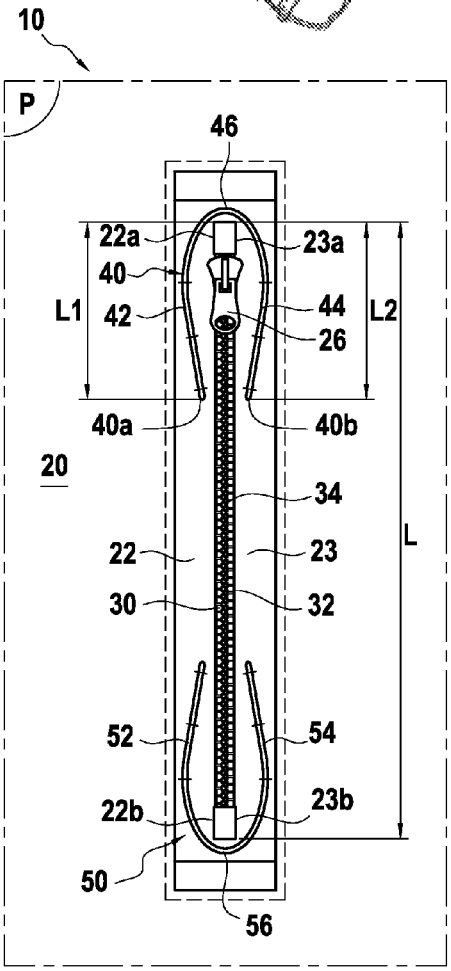
FIG. 2 illustrates a first embodiment of a ventilation device according to the disclosure, in which the closing devices are in the closed position.
Figure 3:
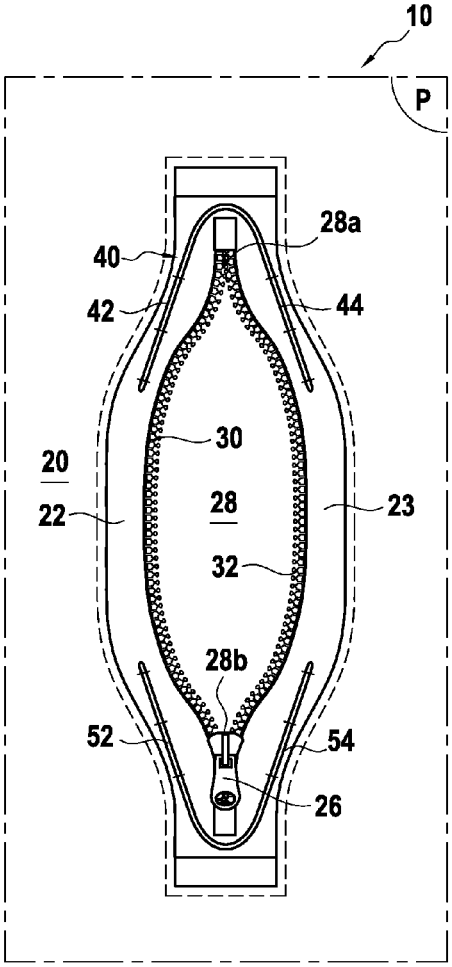
FIG. 3 illustrates the ventilation device of FIG. 2, in which the closing devices are in the open position.

A first embodiment of a ventilation device according to the disclosure is shown in FIGS. 2 and 3. In this example, the ventilation device 10 comprises a flexible support 20, first and second closing device 30,32 and two elastic spacer members 40,50. In a non-limiting manner, the ventilation device 10 could comprise only a single elastic spacer member 40.

The flexible support 20 can be a sheet of a textile material or any other deformable material, preferably being able to be folded or wound over itself. The flexible support 20 can be a tent canopy, a sleeping bag or a portion of a garment such as a sleeve of a jacket. It extends in a plane P.

The flexible support 20 comprises a first edge 22 and a second edge 23. The first and second edges 22,23 each comprise a first end 22*a*,23*a* and a second end 22*b*,23*b*, opposite to the first end.

They both further have the same length L. The first edge 22 is provided with the first closing device 30 and the second edge 23 is provided with the second closing device 32. In this non-limiting example, the first closing device 30 comprises a first zipper portion and the second closing device 32 comprises a second zipper portion. These first and second zipper portions each comprise a plurality of engagement elements 34. The engagement elements 34 of the first zipper portion are configured to cooperate with the engagement elements 34 of the second zipper portion.

The ventilation device further comprises a cursor configured to slide along the first and second closing devices 30,32. The first edge 22 extends over the entire length of the first zipper portion and the second edge 23 extends over the entire length of the second zipper portion.

The closing devices 30,32 can assume a closed position, illustrated in FIG. 2, and an open position illustrated in FIG. 3.

In this non-limiting example, the first and second elastic spacer members 40,50 are identical. Thus, only the first elastic spacer member 40 will be described in detail below.

Figure 4:
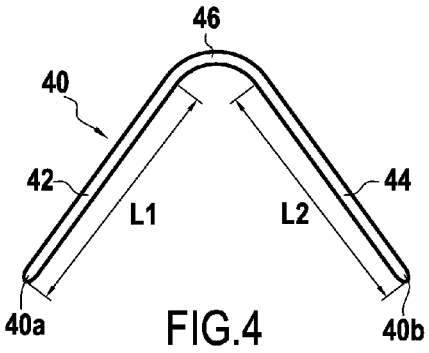
FIG. 4 illustrates a first variant of a spacer member of the ventilation device according to the disclosure.

A first non-limiting variant of the first elastic spacer member 40 is shown in FIG. 4 in a deployed position. It includes a flexible arched stem of plastic material. It has a "V" shape when it is deployed. Without departing from the scope of the disclosure, the first spacer member would be substantially rectilinear in the deployed position.

The first spacer member 40 comprises a first tab 42 having a length $L_1$ and a second tab 44 having a length $L_2$. In a non-limiting manner, the length $L_2$ of the second tab 44 is substantially equal to the length $L_1$ of the first tab 42.

The first tab 42 of the first elastic spacer member 40 has a first end 40*a*, corresponding to a first free end of said first elastic spacer member 40. The second tab 44 of the first spacer member includes a first end 40*b*, opposite to the first end 40*a* of the first tab 42, and corresponding to a second free end of the first spacer member 40. The first spacer member 40 also comprises a central portion 46 from which extend the first 42 and second 44 tabs.

The first spacer member 40 can be further constrained by moving its first tab 42 and its second tab 44 closer to one another. The first spacer member is then placed in the folded position in which its first and second tabs tend to separate from one another.

Referring again to FIG. 2, it is observed that the first elastic spacer member 40 is attached to the flexible support 20 in proximity to the first ends 22*a*,23*a* of the first and second edges 22,23. In particular, the central portion 46 of the first elastic spacer member 40 is attached to the flexible support 20 in proximity to said first ends 22*a*,23*a*.

The second spacer member 50 also comprises a first tab 52, a second tab 54 and a central portion 56. It is attached to the flexible support 20 in proximity to the second ends 22*b*,23*b* of the first and second edges 22,23. In particular, the central portion 56 of the second elastic spacer member 50 is attached to the flexible support in proximity to the second ends 22*b*,23*b*.

In this non-limiting example, the first elastic spacer member 40 is sewn to the flexible support.

It is noted in FIG. 2 that, according to the disclosure, the length $L_1$ of the first tab 42 is less than half the length L of the first edge 22. Preferably, the length $L_1$ of the first tab 42 is less than one-third of the length L of the first edge 22 and, also preferably, approximately equal to one-quarter of the length L of the first edge. The first end 40*a* of the first tab is attached to the flexible support 20 at less than half the length L of the first edge.

Moreover, the length $L_2$ of the second tab is less than half the length L of the second edge 23, preferably less than one-third of the length L of the second edge and still preferably approximately equal to one-quarter of the length L of the second edge 23. In addition, the first end 40*b* of the second tab 44 is attached to the flexible support 20 on the second edge at less than half the length L of the second edge 23.

The first and second elastic spacer members 40,50 extend in a plane substantially parallel to the plane P of the flexible support 20 and of the first and second edges 22,23. The first and second edges 52,54 of the second elastic spacer member have substantially the same length as the first and second tabs 42,44 of the first elastic spacer member.

FIG. 2 shows the ventilation device 10 according to the disclosure in which the first and second closing devices 30,32 are placed in a closed position. In this closed position, the engagement elements 34 of the first zipper portion and of the second zipper portion cooperate so that the first and second edges 22,23 also cooperate and are positioned in proximity to one another, edge to edge and substantially parallel.

Consequently, in this closed position, the first tab 42 of the first elastic spacer member 40, extending along the first edge 22, and the second tab 44 of the first spacer member, extending along the second edge 23, are located near one another. The first elastic spacer member 40 is therefore constrained and in the folded position and its first and second tabs 42,44, tend to be spaced and to separate from one another. However, the closing devices 30,32 being in the closed position, they oppose the spacing of said tabs.

Likewise, in this closed position, the second spacer member 50 is constrained and its first and second tabs 52,54 tend to be spaced and to separate from one another. However, the closing devices 30,32 being in the closed position, they oppose the spacing of said tabs.

The closing devices can then be placed in an open position. To this end, as illustrated in FIG. 3, it is necessary to slide the cursor 26 in a first direction, along the first and second closing devices 30,32. This has the effect of breaking off the cooperation between the engagement elements 34 of the first and second zipper portions of the first and second closing devices. The first and second edges 22,23 then delimit a longitudinal opening 28 having a longitudinal direction.

The longitudinal opening 28 has a first end 28*a*, surrounded by the first elastic spacer member 40 and a second end 28*b*, surrounded by the second elastic spacer member 50.

The first ends 22*a*,23*a* of the first and second edges 22,23 join at the first end 28*a* of the opening 28 and the second ends 22*b*,23*b* of the first and second edges 22,23 join at the second end 28*b* of the opening 28.

The first elastic spacer member 40 is attached to the flexible support 20 in proximity to the first end 28*a* of the longitudinal opening 28. In particular, the central portion 46 of the first elastic spacer member 40 is attached to the flexible support 20 in proximity to said first end of the longitudinal opening 28.

During passage from the closed position to the open position, the first and second spacer members 40,50, which until then were constrained by the cooperation between the closing devices, are deployed.

The first and second tabs 42,44 of the first spacer member 40 are spaced and separate from one another. Inasmuch as the first and second tabs 42,44 of the first spacer device 40 are attached along the first and second edges 22,23, they cause a spacing and a separation of said edges relative to one another, in a direction transverse to the edges. The opening 28 is then delimited by the first and second edges 22,23.

The tabs 52,54 of the second spacer member 50 also separate from one another, which further improves the spacing of the first and second edges and increases the dimensions of the longitudinal opening 28 in said direction transverse to the edges.

Inasmuch as the length of the tabs of the elastic spacer members 40,50 is less than half the length L of the edges 22,23, the angle formed by the tabs relative to a longitudinal direction of the longitudinal opening is large, preferably greater than 10°, and a maximum spacing force is exerted on the first and second edges 22,23.

The angle formed by the tables of the elastic spacer members 40,50 according to the disclosure, relative to a longitudinal direction of the longitudinal opening 28 is much greater than the angle formed by the tabs of the devices of the prior art, relative to said longitudinal direction of the longitudinal opening.

Moreover, the first end 40*a* of the first tab 42 and the first end 40*b* of the second tab 44 are attached to the flexible support between the half and the first end 22*a*,23*a* respectively of the first and second edges 22,23, where the first and second edges can have a maximum spacing.

The opening can again be blocked by sliding the cursor 26 along the first and second closing devices 30,32 in a second direction, the engagement elements 34 of the first and second zipper portions of the first and second closing devices 30,32 then cooperate and the first and second edges 22,23 are brought closer. The closing devices are placed in the closed position and the ventilation device 10 is again in the condition illustrated in FIG. 2.

Figure 5:
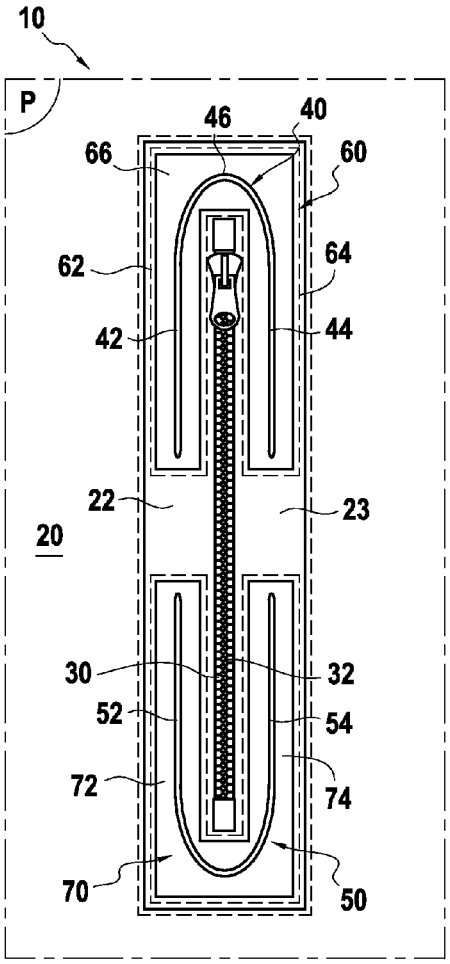
FIG. 5 illustrates a second embodiment of a ventilation device according to the disclosure, in which the closing devices are in the closed position.
Figure 6:
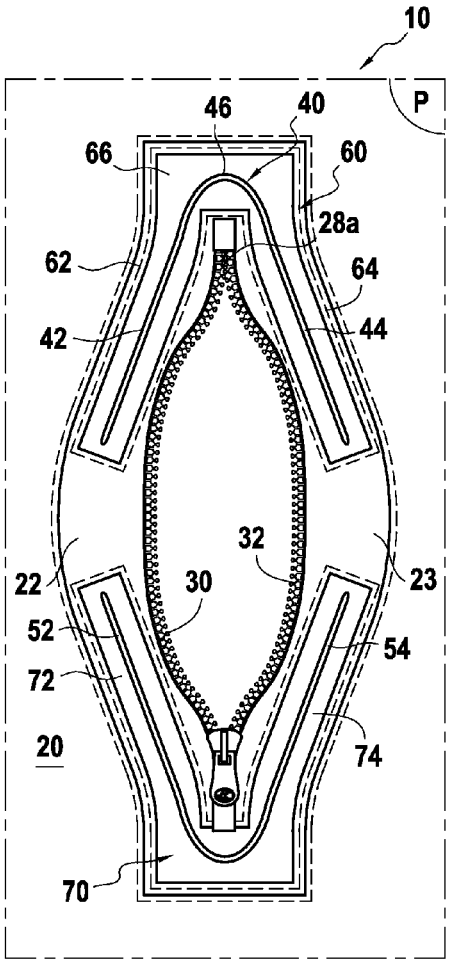
FIG. 6 illustrates the ventilation device of FIG. 5, in which the closing devices are in the open position.

FIG. 5 illustrates a second embodiment of the ventilation device according to the disclosure. In this example, the ventilation device 10 also comprises a first sheath 60 integral with the flexible support 20, in which the first spacer member 40 extends, and a second sheath 70 integral with the flexible support 20, in which the second elastic spacer member 50 extends.

The first sheath 60 comprises a first lateral portion 62, extending along the first edges 22, and receiving the first tab 42 of the first elastic spacer member 40. It further comprises a second lateral portion 64, extending along the second edge 23, and receiving the second tab 44 of the first elastic spacer member.

The second sheath 70 comprises a first lateral portion 72, extending along the first edge 22 and receiving the first tab 52 of the second elastic spacer member 50. It further comprises a second lateral portion 74, extending along the second edge 23, and receiving the second tab 54 of the second elastic spacer member 50.

The first and second sheaths 60,70 allow maintaining the first and second elastic spacer members 40,50 in substantially the same plane parallel to the plane P of the flexible support 20 and to guide the tabs of said elastic spacer member along the edges.

When the closing devices 30,32 are placed in the open position, the tabs of the first and second elastic spacer members 40,50 are spaced, which causes a separation of the lateral portions of the first and second sheaths 60,70 and therefore a separation of the first and second edges 22,23 relative to one another. The sheaths 60,70 therefore allow guiding the elastic spacer members and attaching them to the flexible support 20.

Figure 7:
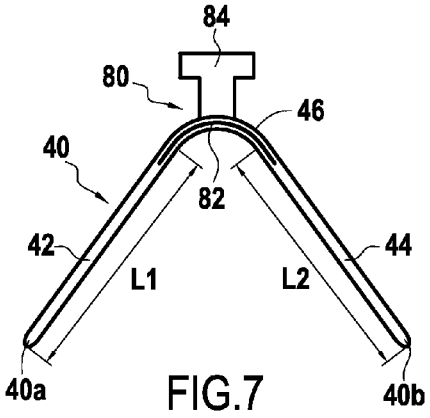
FIG. 7 illustrates a second variant of a spacer member of the ventilation device according to the disclosure.

A second variant of an elastic spacer member 10 of the ventilation device according to the disclosure is illustrated in FIG. 7. In this non-limiting example, the elastic spacer member is provided with a reinforcing part 80.

This reinforcing part 80 comprises, in a non-limiting manner, an insert portion 82 extending inside the elastic spacer member 40 at the central portion 46 and partially at the first and second tabs 42,44. The insert portion reinforces the spacer members and avoids its breakage when it is constrained.

The reinforcing part 80 also comprises an attachment portion 84 protruding from the central portion 46 of the elastic spacer member 40 and allowing attaching said spacer member to the flexible support 20.

The reinforcing part 80 can be made of a different material from that of the elastic spacer member.

The invention claimed is:

1. A ventilation device comprising:

a flexible support having a first edge and a second edge provided with first and second closing devices arranged to cooperate with one another, the closing devices having an open position in which the first and second edges are separated from one another so as to delimit a longitudinal opening in the flexible support, and a closed position in which the first and second edges cooperate so as to block the longitudinal opening, a first elastic spacer member which includes a first tab extending along the first edge and a second tab extending along the second edge, and a second elastic spacer member which includes a first tab extending along the first edge and a second tab extending along the second edge, wherein, when the closing devices are in the closed position, the first elastic spacer member is constrained so that the first and second tabs of the first elastic spacer member tend to separate from one another, the length of at least the first tab of the first elastic spacer member being less than half the length of the first edge, and wherein, when the closing devices are in the closed position, the second elastic spacer member is constrained so that the first and second tabs of the second elastic spacer member tend to separate from one another, the length of at least the first tab of the second elastic spacer member being less than half the length of the first edge.

2. The ventilation device according to claim 1, wherein the length of the first tab of the first elastic spacer member is less than one-third of the length of the first edge.

3. The ventilation device according to claim 1, wherein the length of the second tab of the first elastic spacer member is less than half the length of the second edge.

4. The ventilation device according to claim 1, wherein the length of the second tab of the first elastic spacer member is substantially equal to the length of the first tab.

5. The ventilation device according to claim 1, wherein the first elastic spacer member comprises a stem of plastic material.

6. The ventilation device according to claim 1, comprising at least one first sheath integral with the flexible support, in which the first elastic spacer member extends at least partially.

7. The ventilation device according to claim 6, wherein the first sheath comprises a first lateral portion extending along the first edge and a second lateral portion extending along the second edge.

8. The ventilation device according to claim 6, comprising a second sheath integral with the flexible support, in which the second elastic spacer member extends at least partially.

9. The ventilation device according to claim 1, comprising a reinforcing part cooperating with the first elastic spacer member.

10. The ventilation device according to claim 1, wherein the first elastic spacer member has a "U" or a "V" shape.

11. The ventilation device according to claim 1, wherein the first elastic spacer member is positioned in proximity to a first end of the longitudinal opening.

12. The ventilation device according to claim 11, wherein the first elastic spacer member comprises a central portion mounted on the flexible support in proximity to the first end of the longitudinal opening.

13. The ventilation device according to claim 1, wherein the second elastic spacer member is positioned in proximity to a second end of the longitudinal opening, opposite to the first end of the longitudinal opening.

14. The ventilation device according to claim 13, wherein the second elastic spacer member comprises a central portion mounted on the flexible support in proximity to the second end of the longitudinal opening.

15. The ventilation device according to claim 1, wherein the first closing device comprises a first zipper portion and wherein the second closing device comprises a second zipper portion, configured to cooperate with the first zipper portion to close the longitudinal opening when the first and second closing devices are placed in the closed position.

16. A garment comprising at least one ventilation device according to claim 1.

17. A tent comprising at least one ventilation device according to claim 1.

18. A sleeping bag comprising at least one ventilation device according to claim 1.

19. A ventilation device comprising:

a flexible support having a first edge and a second edge provided with first and second closing devices arranged to cooperate with one another, the closing devices having an open position in which the first and second edges are separated from one another so as to delimit a longitudinal opening in the flexible support, and a closed position in which the first and second edges cooperate so as to block the longitudinal opening, a first elastic spacer member which comprises a stem of plastic material, the first elastic spacer member including a first tab extending along the first edge and a second tab extending along the second edge, and a second elastic spacer member which includes a first tab extending along the first edge and a second tab extending along the second edge, wherein, when the closing devices are in the closed position, the first elastic spacer member is constrained so that the first and second tabs of the first elastic spacer member tend to separate from one another, the length of at least the first tab of the first elastic spacer member being less than half the length of the first edge, and wherein, when the closing devices are in the closed position, the second elastic spacer member is constrained so that the first and second tabs of the second elastic spacer member tend to separate from one another, the length of at least the first tab of the second elastic spacer member being less than half the length of the first edge.

* * * * *